US006914989B2

(12) United States Patent
Janse et al.

(10) Patent No.: US 6,914,989 B2
(45) Date of Patent: Jul. 5, 2005

(54) DEVICE AND METHOD FOR CALIBRATION OF A MICROPHONE

(75) Inventors: Cornelis Pieter Janse, Eindhoven (NL); Harm Jan Willem Belt, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 657 days.

(21) Appl. No.: 09/894,082

(22) Filed: Jun. 28, 2001

(65) Prior Publication Data

US 2003/0076965 A1 Apr. 24, 2003

(30) Foreign Application Priority Data

Jun. 30, 2000 (EP) ..... 00202298

(51) Int. Cl.[7] ..... H04R 3/00
(52) U.S. Cl. ..... 381/92; 381/122; 381/58
(58) Field of Search ..... 381/92, 58, 111, 381/112, 113, 114, 115, 116, 117, 56, 122

(56) References Cited

U.S. PATENT DOCUMENTS 5,029,215 A * 7/1991 Miller, II ..... 381/58
5,841,876 A * 11/1998 Gifford et al. ..... 381/71.14
5,844,994 A 12/1998 Graumann ..... 381/56

FOREIGN PATENT DOCUMENTS

WO WO9927522 6/1999 ..... G10L/3/00

* cited by examiner

*Primary Examiner*—Sinh Tran
*Assistant Examiner*—Justin Michalski

(57) ABSTRACT

A device for and method of calibrating a microphone, includes a loudspeaker (3) for converting a loudspeaker input signal (5) into sound; a microphone (4) for converting received sound into a microphone output signal (16), and a calibration arrangement for calibrating an output power of the microphone relative to a desired power level. The calibration arrangement includes an impulse response estimating device (7) for estimating an acoustic impulse response of the microphone by correlating the microphone output signal (6) and the loudspeaker input signal (5) when the microphone (4) receives the sound from the loudspeaker (3), whereby the output power of the microphone (4) is estimated.

10 Claims, 5 Drawing Sheets

DEVICE AND METHOD FOR CALIBRATION OF A MICROPHONE

BACKGROUND OF THE INVENTION

1. Field of the Invention Technology

The present invention relates to microphone output signal levels, and more specifically, to the calibration thereof to a desired level. When output levels of different microphones are compared, it is assumed that the acoustical excitations thereof are identical. Manufacturers supply microphones having output levels varying around a specified mean value. For the often-used back-electret microphones, such tolerances are ±4 dB. Consequently, the output levels of such microphones may show a difference of up to 8 dB. Microphones with tolerances of ±2 dB are sometimes available. These, however, are more expensive.

2. Description of the Related Art

A usual approach for gain calibration of a microphone is carried out in an anechoic chamber, i.e., a chamber without reflections or reverberation. A loudspeaker is placed in front of the microphone (at an angle of 0°) inside the anechoic chamber. The loudspeaker plays a noise sequence at a known power level and the power of the microphone response is measured. Subsequently, an adjustable gain is set.

Further an audio processing arrangement is disclosed in International Patent Application No. WO 99/27522. According to this prior art reference, filtered sum and weighted sum beamforming are developed for maximizing power at the output. Filtered sum beamforming (FSB) makes the direct contributions maximally coherent upon adding thereof.

With multi-microphone algorithms such as beamforming, it is very important to sort the microphones during production to obtain sets with level differences within the required tolerances.

Moreover, with some multi-microphones systems, the consumer may buy additional microphones later in time, which will also have to be calibrated before installation.

SUMMARY OF THE INVENTION

The present invention provides a device for calibration of a microphone, comprising:

a loudspeaker for converting a loudspeaker input signal into sound;

a microphone for converting received sound into a microphone output signal, and calibration means for calibrating the output power of the microphone relative to a desired power level, said calibration means comprising impulse response estimating means for estimating an acoustic impulse response of the microphone and/or the environment at the microphone by correlating the microphone output signal and the loudspeaker input signal when the microphone receives sound from the loudspeaker, whereby the output power of the microphone is estimated.

As indicated above, calibration of microphones is often of crucial importance for good performance of multi-microphone systems. The present invention is concerned with the adaptive calibration (in software) of microphones under reverberant room conditions. An advantage of the present invention is that the microphones need not be selected or calibrated when manufacturing an audio system, saving production time and, sometimes, additional hardware. The present invention can be applied in all speech communication systems where one or more microphones and a loudspeaker are available. One can think of hands-free telecommunication systems, but also of hands-free speech recognition systems for voice control of, e.g., a television set.

Non-uniformly ageing of microphones, which can also lead to output level differences, will also be neutralized by this invention.

In a preferred embodiment of the invention, direct part removal means are provided for removing the direct part of the so-called acoustic impulse response (a.i.r.) in order to use, especially, the diffuse part of the a.i.r. An advantage hereof is that calibration can be executed during use in a normal environment, e.g., a room of a microphone, and without the need for additional hardware. Calibration during the actual use also allows for either absolute calibration or relative calibration.

Another preferred embodiment comprises high- and low-pass filter means for filtering low and high frequencies, allowing for better calibration by using frequency ranges where signal quality is best suitable for processing.

Another preferred embodiment comprises squaring and summation means for creating a representation of the current power level of the diffuse sound-field response of the microphone, in order to create a value that can be related to a desired level.

The invention further preferably comprises relating means for relating the power level of the (diffuse) microphone response with a desired power level.

Although it may be possible to obtain an absolute value for the desired power level, this desired power level is preferably available from a reference microphone.

BRIEF DESCRIPTION OF THE DRAWINGS

Further advantages, features, and details of the present invention will become clear when reading the following description with reference to the annexed drawings, in which.

DESCRIPTION OF THE PREFERRED EMBODIMENTS

Figure 1:
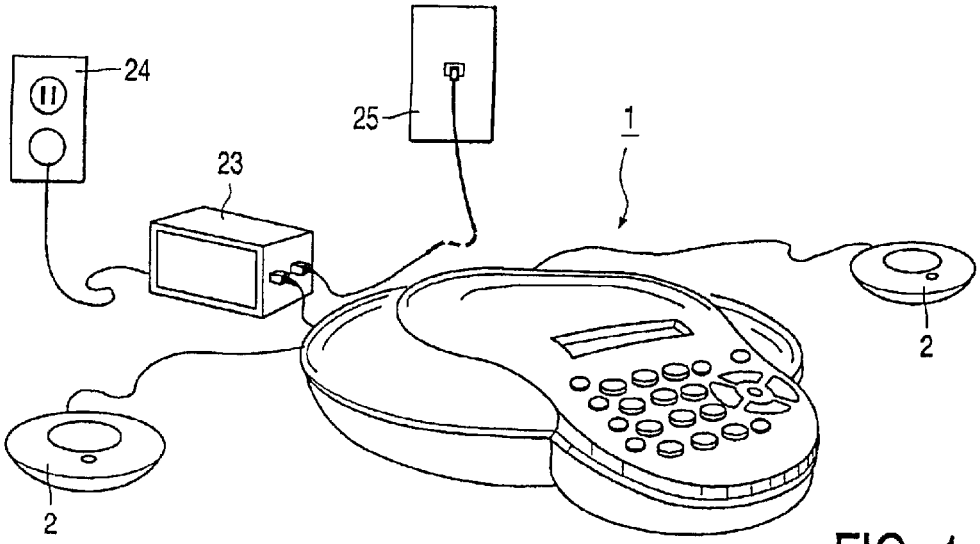
FIG. 1 is a perspective and partly diagrammatic view of a preferred embodiment of present invention in an audio conferencing system.

FIG. 1 shows an audio conferencing system comprising a main console 1 and one or two satellite microphones 2 for a larger pick-up range of speech, each satellite microphone containing a microphone. The audio conferencing system is connected to a floor unit 23, which, in turn, is connected to a power source 24 and a telephone network 25 of some kind, e.g., a PSTN (RJ11) or an ISDN (RJ45). The main console comprises, a loudspeaker for producing (voice) sounds, and three microphones for picking up (voice) sound. Furthermore, telephone means are included for making contact to other telephones through a telephone network. The microphones preferably inter-operate as seamlessly as possible. For this purpose, the invention provides means of eliminating the need of pre-installation calibration of the microphones in the satellite microphones or even of the microphones in the main console.

Another example of use of a device according to present invention (not shown), relates to voice-based commanding of a television set, e.g., for switching channels or controlling the volume, by using microphone input. This can also be embodied in a form with one or several microphones. In order for a system to use the microphone output signal, calibration may be necessary.

Figure 2:
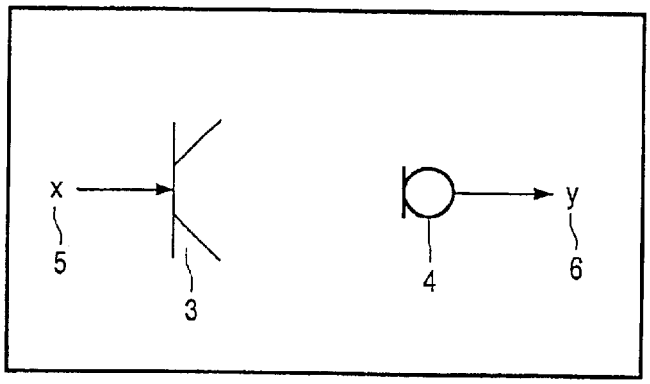
FIG. 2 is a diagram of a prior art setting for calibration of a microphone in an anechoic chamber.

For clarification, some acoustical concepts are explained that are relevant for understanding the detailed description of the drawings. FIG. 2 shows a room containing a loudspeaker 3 and a microphone 4 aimed towards that loudspeaker (thus at 0°).

Figure 3:
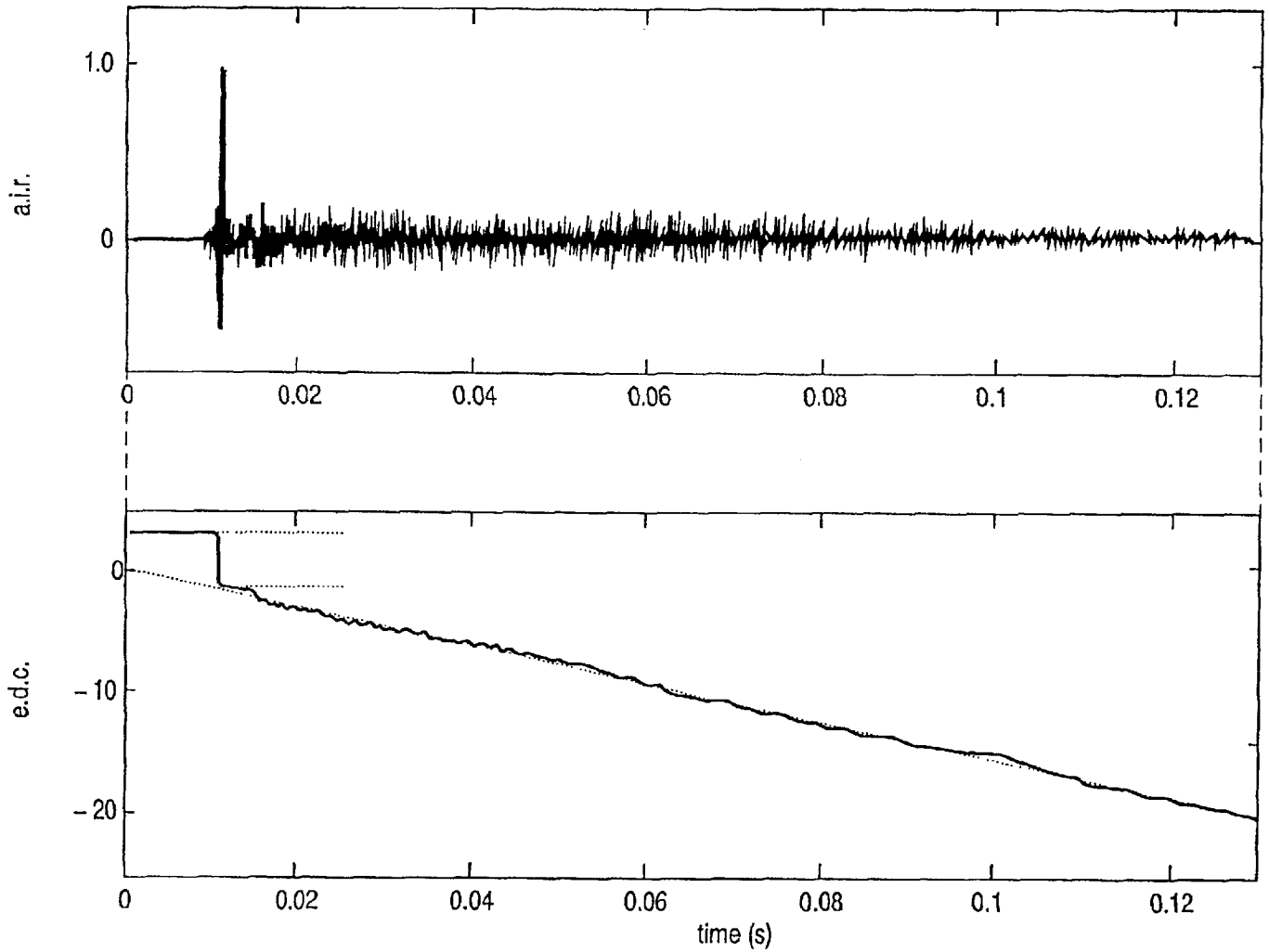
FIG. 3 shows graphs of a typical a.i.r. at 0° of a microphone and a corresponding energy decay curve (e.d.c.) as a function of time.

An acoustic impulse response (a.i.r.) can be estimated from the loudspeaker excitation signal and the microphone response by correlation techniques. An a.i.r. is the response on an impulsive acoustic excitation. An example of such an estimated a.i.r. is depicted in FIG. 3. During the first few milliseconds, the response is zero due to the delay from the limited speed of sound in air. Next, a large peak can be observed, which is due to the response to the direct acoustic propagation of the sound from the speaker towards the microphone, and is called the direct sound field contribution. This peak has a normalized value of 1.0. The tail relates to this value as depicted in this graph. The tail of the a.i.r. is due to reflections against room boundaries, and is called the diffuse sound field contribution. These reflections have a random character and increase statistically in density and decrease exponentially in amplitude over time. The combined effects of the reflections are called reverberation.

An important function of the a.i.r. is the energy decay. In discrete time, with n the sample index, the energy decay at index n amounts to the energy left in the tail of the a.i.r. In FIG. 3, the so-called energy decay curve (e.d.c.) corresponding to a.i.r. is also logarithmically plotted. On the Y-axis, the quantity is measured in dB. The e.d.c. shows an abrupt change due to the direct component. The difference in energy decay just before and just after this jump is called the clarity index. A larger clarity index implies a larger direct/diffuse ratio, and thus, less reverberation. The envelope of the diffuse tail of the a.i.r. has an exponential decay which leads to the constant slope of the logarithm of the tail of the e.d.c. The reverberation time T60 is the time interval in which the reverberation level drops down by 60 dB. It is found for this case that T60=0.36 s.

Microphones can have unidirectional beam patterns. Unidirectional microphones only pick up acoustic signals from a certain range of angles around 0°, i.e., they more or less block acoustic signals arriving at 180°. This means that the direct field contribution of an a.i.r. measured at 180° will be almost zero.

Figure 4:
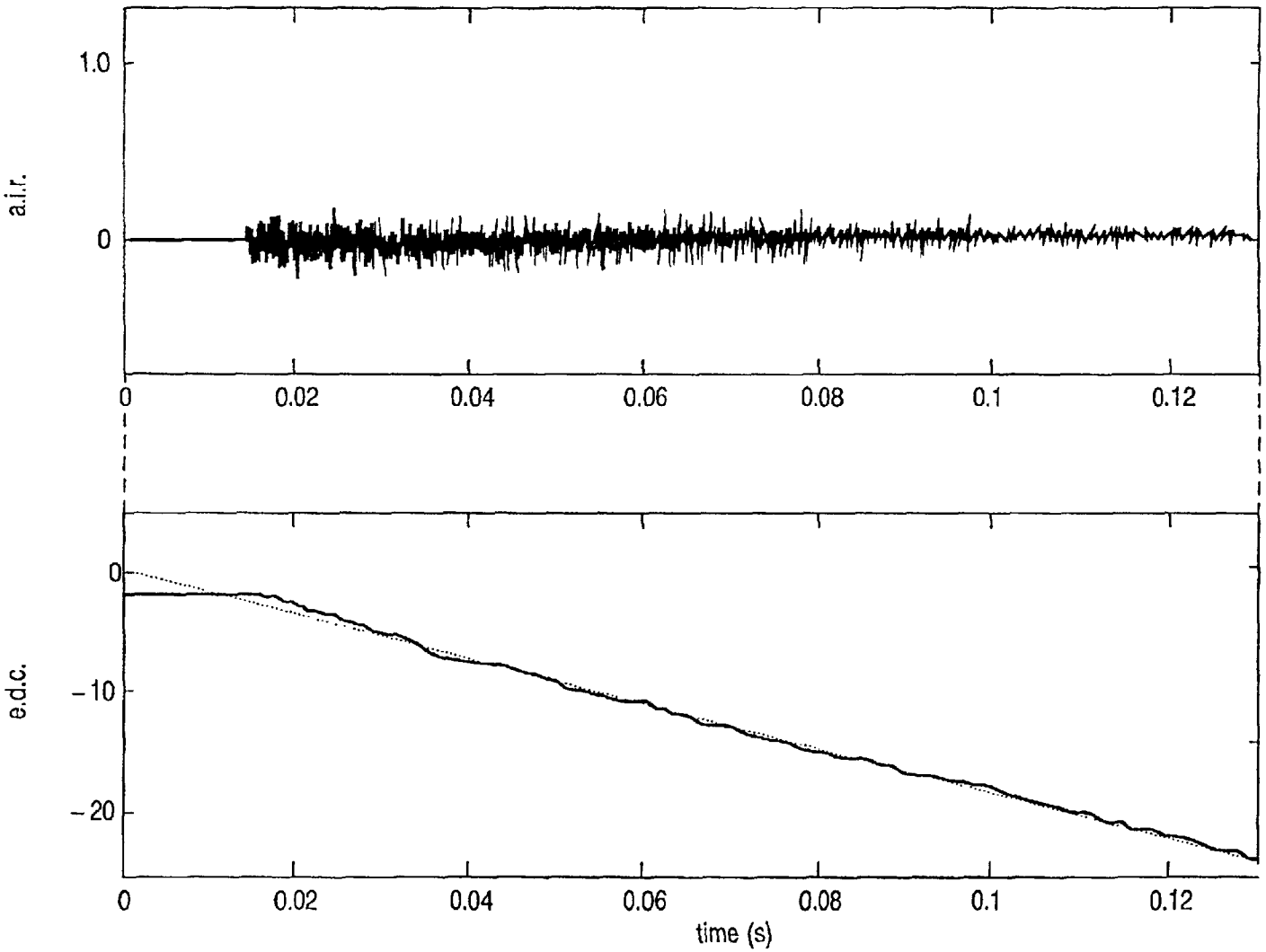
FIG. 4 shows graphs of a typical a.i.r. at 180° on the same microphone as in FIG. 3, and the corresponding decay curve (e.d.c.) as a function of time.

In FIG. 4, the a.i.r. and the e.d.c. of the same (unidirectional) microphone as in FIG. 3, but now at 180°, are plotted. There also is a value normalized to one, yet only the tail is shown as this represents the diffuse response. By comparing FIG. 3 and FIG. 4, it appears that at 180°, the direct contribution has vanished while the diffuse contribution has the same exponential envelope in both Figs.

In the following, it is assumed that the energy in the diffuse tail of the a.i.r. does not depend on the microphone or loudspeaker orientation and location in the room. In practice, some variation are found depending on orientation and location, but these variations are small when the acoustic absorption pattern in the room is more or less homogenous and the reverberation over time is not to small (T60>100 ms). It is worth mentioning that a typical room has a reverberation larger than 300 ms. A general rule is that the bigger a room, the longer the reverberation time.

The present invention uses, as input, not only the microphone response, but also the excitation signal of the loudspeaker (FIG. 2). First, the a.i.r. is estimated from the loudspeaker to the microphone using a well-known correlation method in the estimating means. When acoustic cancellation is performed, this adaptive filter is already available. The diffuse part of the a.i.r. is selected in the direct part removal means. At low frequencies, the loudspeaker output and/or the microphone sensitivity is low, which leads to unreliable a.i.r. coefficients. Therefore, a high-pass filter is applied to the diffuse part of the a.i.r. At the highest frequencies, near the Nyquist frequency, the signal levels will also be low due to anti-aliasing filters. Thus, to deal with unreliable a.i.r. coefficients at high frequencies, a low-pass filter is applied.

Figure 5:
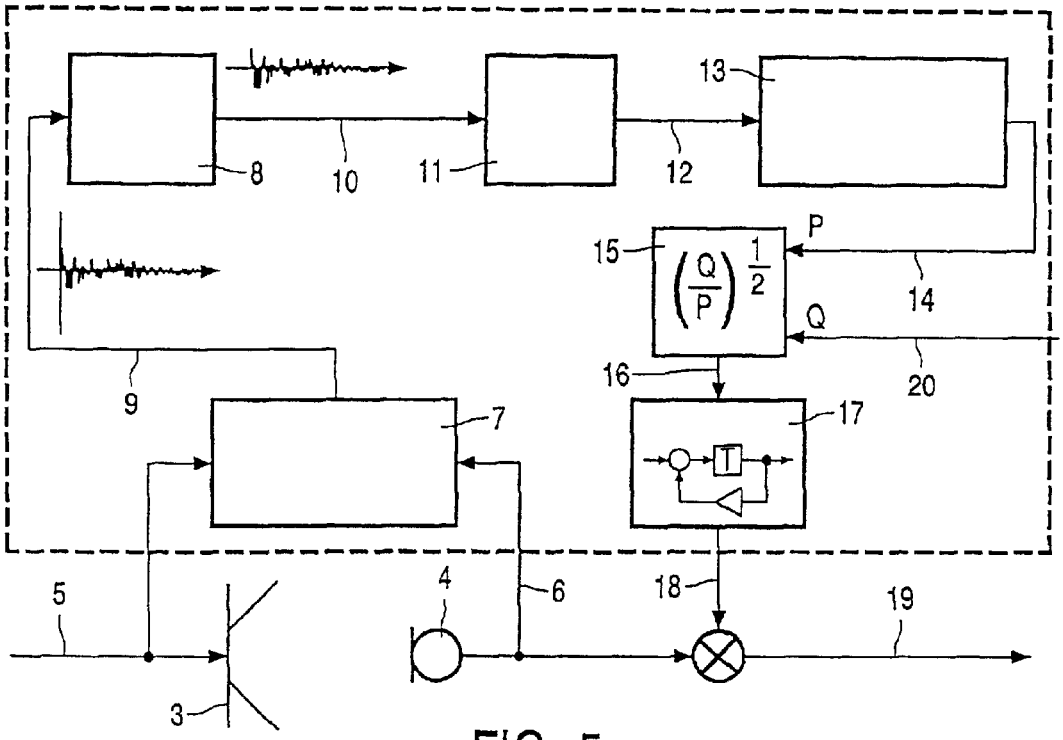
FIG. 5 is a diagram of adaptive microphone calibration as included in the embodiment of FIG. 1.

In FIG. 5, these high- and low-pass filters are combined to form a band-pass filter. The filtered coefficients are squared and summed in the squaring and summation means, which leads to actual power level 14 representing the current power of the diffuse microphone response. This power level is related to a desired power level 20 and the gain factor is determined as the square root of the quotient of these power levels.

In the preferred embodiment, this calibration method can be applied each time the adaptive filter comes up with a new estimation of the a.i.r. For increased robustness of an acoustic echo canceller, a programmable filter is sometimes used (as described in U.S. Pat. No. 4,903,247). The adaptive filter runs in the background and the programmable filter, which takes its coefficients conditionally from the adaptive filter, is used for the actual echo removal. In this case, it is best to take the coefficients of the programmable filter and apply the calibration procedure after each coefficient transfer.

The loudspeaker 3 (FIG. 5) gets a loudspeaker input signal 5. Microphone 4 receives the sound that is being produced by the loudspeaker 3 and transforms this into microphone output signal 6. Digital values of signals 5 and 6 are fed to estimator 7. The estimator 7 produces estimated values 9 that pass through to direct part removal part 8 embodied in software. From here, digital values 10 are fed to digital band-pass filters 11. Signals 12 from these band-pass filters are fed to a squaring and summation program 13.

The estimated actual power level (P) 14 is fed to a relating program 15 as is an (external) desired power level (Q) 20. From here, the calibration gain factor 16 is fed to the averaging means 17. An adjusted calibration gain factor 18 is fed back to the microphone output signal in order to form the calibrated signal 19.

Especially when combined with an adaptive filter for acoustic echo cancellation, the proposed microphone calibration method can be applied all the time that the system is active. In FIG. 5, the calibration factor, being the square root of the desired power level divided by the actual power level, is averaged to ensure that successive calibration gain factors will change smoothly. Such averaging can be done with a first-order recursion. This averaging procedure can also be applied to the actual power 14 and the desired power 20 before the calculation of the square root of the desired power level divided by the actual power level.

Below, the process of the embodiment of FIG. 5 is described. This preferred embodiment of the present invention requires, as input, not only the microphone response 6, but also the excitation signal 5 of the loudspeaker (FIG. 2). First, the a.i.r. is estimated from the loudspeaker to the microphone using a correlation method in the estimating means 7. Only the diffuse part of the a.i.r. is selected in the direct part removal means 8. The band-pass filter 11 is used for filtering out high and low frequencies. The filtered coefficients are squared and summed in the squaring and summation means 13, which leads to actual power level 14 representing the current power of the diffuse microphone response. This power level is related to a desired power level 20, and the gain factor is determined as the square root of the desired power level divided by the actual power level.

Figure 6:
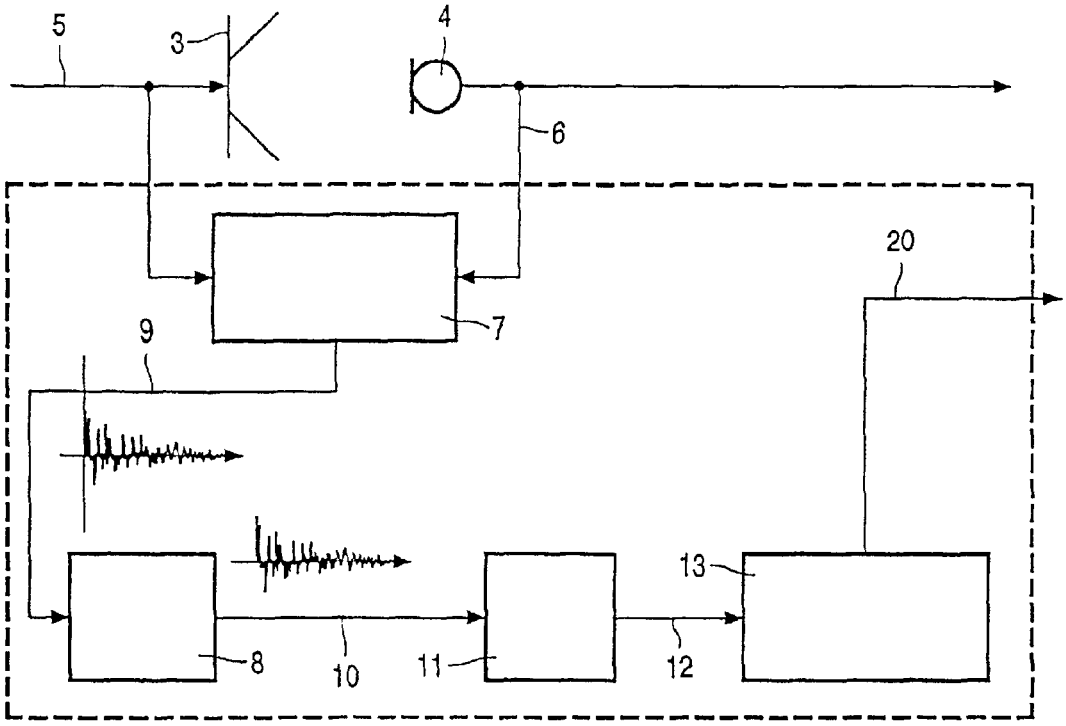
FIG. 6 is a diagram of adaptive microphone calibration relative to a reference microphone which can also be used in the embodiment of FIG. 1.

FIG. 6 shows the same configuration as FIG. 5 except for the averaging means 17 and relating program 15. This configuration is used in case of referential calibration for the reference microphone, whereby the desired power level 20 is input for the relating means 15 of the other microphones calibration means using the reference microphone as their reference.

Figure 7:
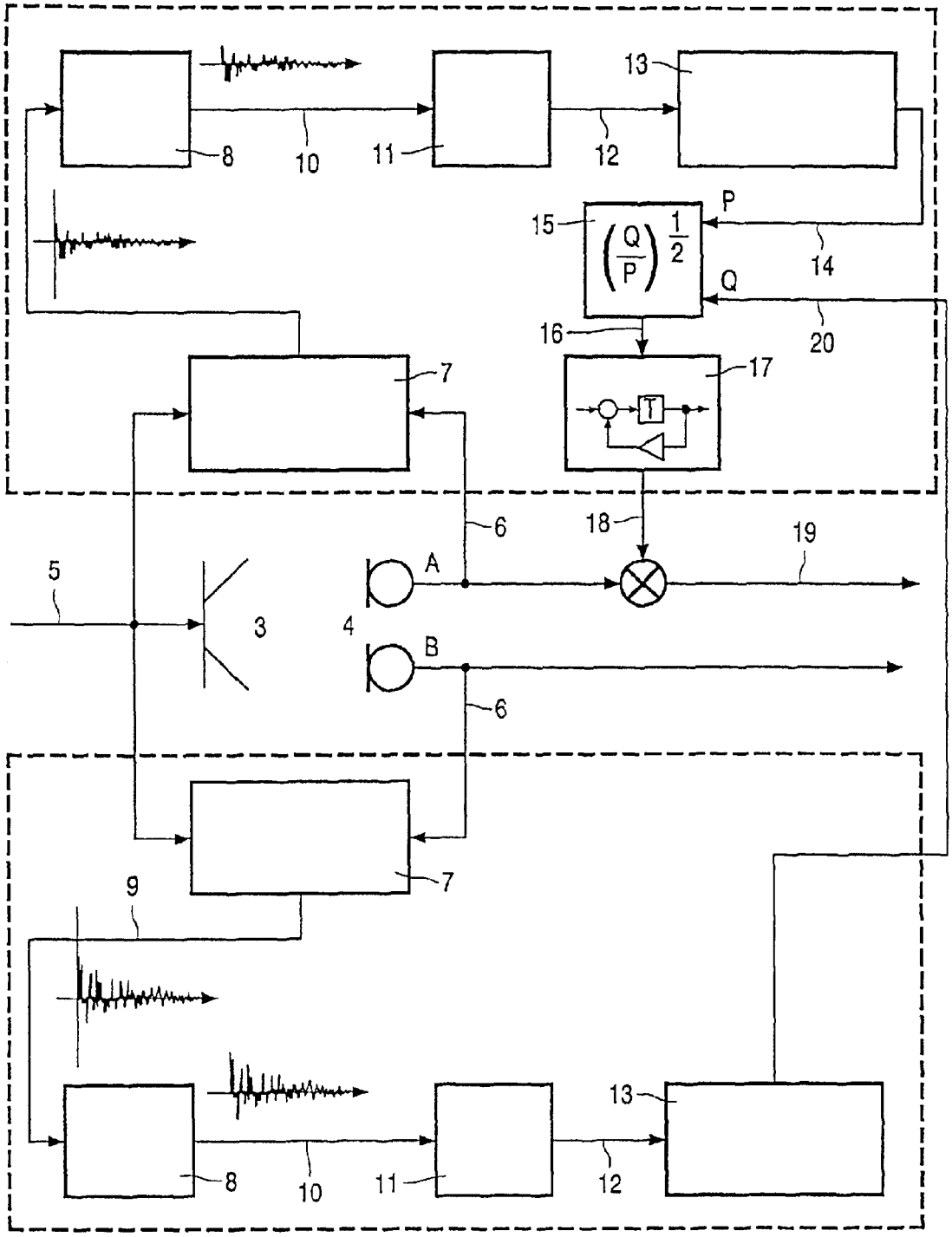
FIG. 7 is a diagram of relative calibration relative to reference microphone which can be also be used in the embodiment of FIG. 1.

FIG. 7 shows how the building blocks of FIG. 5 and 6 can be combined for referential calibration for use in, e.g., an audio conferencing system as in FIG. 1.

Figure 8:
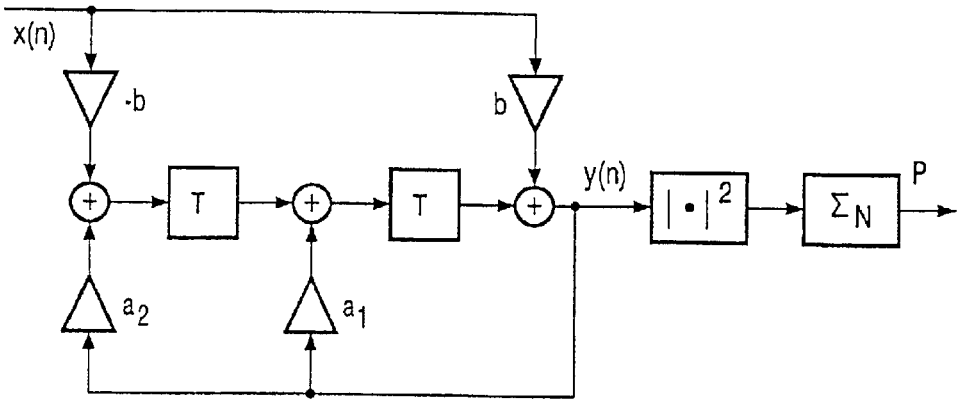
FIG. 8 is a diagram of a band-pass filter and subsequent squaring and summation operation for use in the embodiments of FIGS. 5–7.

FIG. 8 shows, graphically, how the averaging algorithm would work in calculating the power P of a diffuse sound-field response of a microphone. The scheme consists of a band-pass filter followed by summation of the squared output values. At a sampling rate of 8 kHz, good filter parameters, leading to low-pass and high-pass cutoff frequencies (−3 dB) of about 200 Hz and 3.6 kHz, respectively, are b=0.800, a1=0.128, and a2=0.621.

The present invention is not limited to the above preferred embodiments; the rights applied for are defined in the annexed claims.

What is claimed is:

1. A device for calibrating a microphone, said device comprising:

a loudspeaker for converting a loudspeaker input signal into sound;

a microphone for converting received sound into a microphone output signal; and calibration means for calibrating an output power of the microphone relative to a desired power level, said calibration means comprising impulse response estimating means for estimating an acoustic impulse response of the microphone by correlating the microphone output signal and the loudspeaker input signal when the microphone receives the sound from the loudspeaker, whereby the output power of the microphone is estimated, wherein said device further comprises:

direct par: extraction means for extracting a direct part of the acoustic impulse response, thereby passing through a diffuse part of the acoustic impulse response.

2. The device as claimed in claim 1, wherein said device further comprises:

high- and low-pass filter means for filtering out low and high frequencies from the diffuse part of the acoustic impulse response.

3. The device as claimed in claim 1, wherein said device further comprises:

squaring and summation means for creating a representation of a current power level of the diffuse part of the acoustic impulse response of the microphone.

4. The device as claimed in claim 2, whereby the high- and low-pass filter means are combined into a band-pass filter.

5. The device as claimed in claim 3, wherein said device further comprises:

relating means, coupled to an output of said squaring and summation means, for relating the current power level of the diffuse part of the acoustic impulse response of the microphone with a desired power level.

6. The device as claimed in claim 5, wherein an output of the relating means is fed back to the microphone output signal as a calibration factor.

7. The device as claimed in claim 5, whereby the desired power level has a predetermined value for absolute calibration of the microphone.

8. The device as claimed in claim 5, wherein said device further comprises a reference microphone for calibration of said microphone relative to the reference microphone, the output of the reference microphone forming the desired power level input for the relating means.

9. The device as claimed in claim 5, wherein said device further comprises:

respective averaging means for averaging said desired power level and said current power level prior to application to said relating means.

10. The device as claimed in claim 6, wherein said device further comprises:

means for averaging the calibration factor.

* * * * *